US005489036A

United States Patent [19]

Arkins

[11] Patent Number: 5,489,036

[45] Date of Patent: Feb. 6, 1996

[54] SCREW THREADED CONTAINER WITH A TRIPLE SEAL

[75] Inventor: Thomas D. Arkins, Ridgefield, Conn.

[73] Assignee: Kraft Foods, Inc., Northfield, Ill.

[21] Appl. No.: 346,794

[22] Filed: Nov. 30, 1994

[51] Int. Cl.[6] ..... B65D 41/04; B65D 1/02

[52] U.S. Cl. ..... 215/343; 215/DIG. 1; 215/384; 215/45; 215/44

[58] Field of Search ..... 215/10, 40, 43–46, 215/246, 341, 343, 344, DIG. 1, DIG. 7, 382, 384

[56] References Cited

U.S. PATENT DOCUMENTS

| | | | |
|---|---|---|---|
| 3,441,161 | 4/1969 | Van Baarn | 215/40 |
| 3,568,871 | 3/1971 | Livingstone | 215/40 |
| 4,442,947 | 4/1984 | Banich | 215/344 |
| 4,566,603 | 1/1986 | Moore | 215/329 |
| 4,907,709 | 3/1990 | Abe et al. | 215/252 |

*Primary Examiner*—Allan N. Shoap
*Assistant Examiner*—Nathan Newhouse
*Attorney, Agent, or Firm*—Thomas R. Savoie; Thomas A. Marcoux

[57] ABSTRACT

A sealed container includes a base jar for containing a substance and a removable lid therefor. The base jar includes an upper portion with a screw thread and an upper wall extending inwardly and upwardly therefrom having a circular brim which defines a wide mouth opening, a brim portion with at least a 10% reduction, and an inside edge. The removable lid includes an encircling member extending downwardly from a top wall with a mating screw thread for the screw thread of the base jar. For sealing with the base jar, the removable lid also includes a circular projection extending downwardly from the lid which engages and seals with the circular brim. For additional sealing, the removable lid further includes a circular flexible flange extending downwardly from the lid having a tip which is radially flexed relative to a remainder of the flange upon engagement with an upper wall of the jar to seal therewith. For further sealing and primary sealing, the top wall of the lid also includes a circular centering and sealing rim which, before engagement of the circular projection with the circular brim, engages the inside edge of the circular brim to form a seal therebetween as well as to positively locate the circular projection vertically adjacent the circular brim.

20 Claims, 6 Drawing Sheets

SCREW THREADED CONTAINER WITH A TRIPLE SEAL

FIELD OF THE INVENTION

The present invention relates generally to a sealed container with a replaceable lid for containing a substance to be protected from an outside environment, and more particularly to a sealed container having three positive seals and an easily replaceable lid.

BACKGROUND OF THE INVENTION

In the packaging of substances, it is frequently desired to protect the substance from the outside environment with a package, while still allowing intermittent access to the substance. For example, where the substance is fructose-containing powdered beverage mix, it is desired to package a number of servings of such a powdered mix in a single package. Thus, a mechanism must be provided with the package for periodic access when the user wishes to remove a serving. However, in the interim (which may be days or even much longer), it is equally important that the powdered mix be completely protected or sealed from moisture in the surrounding environment.

While various packages of this type have been proposed in the prior art, various drawbacks have existed with such packages. Among the drawbacks has been: incomplete sealing of the substances from the environment, difficult access mechanisms, hard to handle packages, and hard to reseal packages.

One package which overcame many of these disadvantages was disclosed in U.S. Pat. No. 5,383,558. While this package was an improvement over previous packages, some leakage would still occasionally occur. Thus, it will be appreciated that the present invention is an improvement over this package.

SUMMARY OF THE INVENTION

In accordance with the present invention, a sealed container which is easily opened and which positively seals a substance therein is provided. The container includes a base jar for containing the substance and a removable lid for closing and sealing the substance in the base jar. This lid is easily and quickly removed and replaced, and is easily and positively placed on the base jar to positively and completely seal the substance from the outside environment prior to the initial opening of the package and during any subsequent in-use cycle.

The base jar includes a bottom wall and a side enclosure extending upwardly from the bottom wall. This side enclosure includes an upper portion disposed radially about a central axis with a screw thread about the upper portion. The base jar also includes an upper wall extending inwardly and upwardly from the upper portion of the side enclosure and radially about the central axis. This upper wall includes a circular brim which defines a mouth opening for the jar, a brim portion adjacent the brim provided with at least a 10% reduction in thickness from an adjoining portion of the upper wall, and an inside edge at an intersection of the circular brim and an inside surface of the brim portion.

The removable lid for the jar which seals the opening includes a top wall disposed about the central axis and an encircling member extending downwardly from the top wall and radially about the central axis. The encircling member includes a screw thread which matingly engages with the screw thread of the upper wall of the jar. For sealing with the base jar, the removable lid also includes a circular projection extending downwardly from the lid and radially about the central axis which engages and seals with the circular brim after the screw threads of the jar and lid engage.

For additional sealing, the removable lid further includes a circular flexible flange extending downwardly from the lid and radially about the circular projection and the central axis. This flexible flange has a tip which is radially flexed relative to a remainder of the flange upon engagement with the upper wall of the jar to seal therewith before the circular projection and circular brim matingly engage.

Finally, for a further and primary sealing, the top wall of the lid includes a circular centering and sealing rim extending downwardly from the top wall and radially just inside and downwardly beyond the circular projection. Thus, before engagement of the circular projection with the circular brim and before engagement of the tip of the flexible flange with the upper wall of the jar, the centering rim engages the inside edge of the upper wall to form a seal therebetween as well as to positively locate the circular projection vertically adjacent and coaxial with the circular brim.

In a preferred embodiment, the reduction in thickness of said brim portion is provided along the inside surface thereof. In addition, the reduction in thickness of the brim portion is about 20% and is an arc shaped concavity. Preferably, the centering rim further includes a lower outside surface which is inclined downwardly and inwardly to aid in this centering action.

In the preferred embodiment, the circular projection is located between the centering rim and the circular flexible flange at a radial position closer to the encircling member than to the circular flexible flange. Also, the inside surface of said brim portion adjacent the inside edge is rounded to better move along and seal with the circular centering rim as engagement of the circular projection with the circular brim and engagement of the tip of the flexible flange with the upper wall of the jar occurs.

In accordance with the preferred embodiment, the upper wall is curved to form a dome. In this preferred embodiment the dome is shaped to be generally hemispherical. Further, the circular brim has a diameter which is 50 to 80% of a diameter of the upper portion of the of the side enclosure, and most preferably about ⅔ of the diameter of the upper portion.

It is an object of the present invention to provide a moisture-proof container which is easily opened and resealed.

It is also an object of the present invention to provide a container with three redundant seals to assure that moisture does not enter the container.

It is a further object of the present invention to provide a container which is easy to produce, use and store.

Other features, advantages and objects of the present invention are stated in or apparent from the detailed description of a presently preferred embodiment of the invention found hereinbelow.

DETAILED DESCRIPTION OF THE PREFERRED EMBODIMENTS

Figure 1:
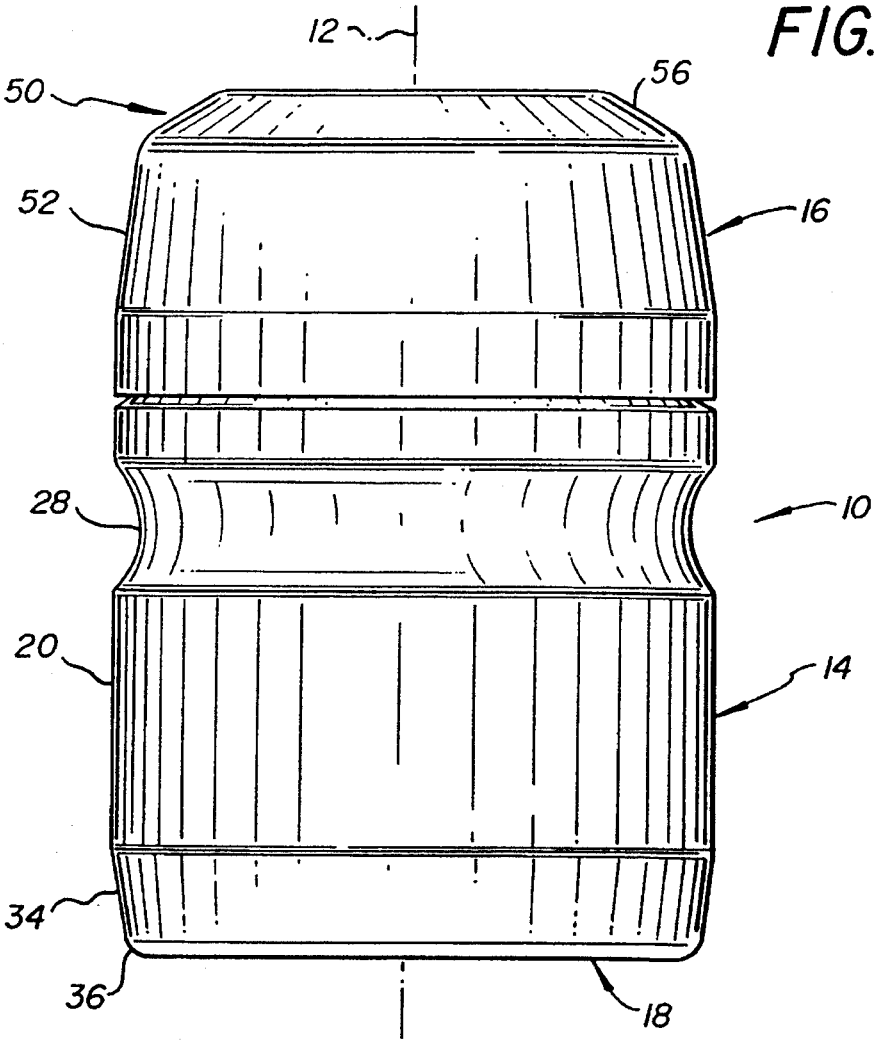
FIG. 1 is an elevation view of the container of the present invention comprised of a base jar and removable lid.
Figure 2:
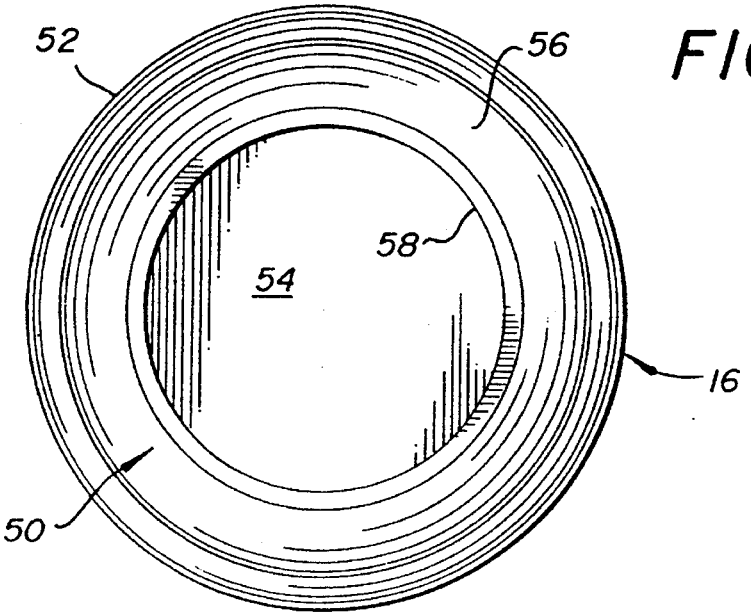
FIG. 2 is a top plan view of the container, and in particular of the lid thereof, depicted in FIG. 1.
Figure 3:
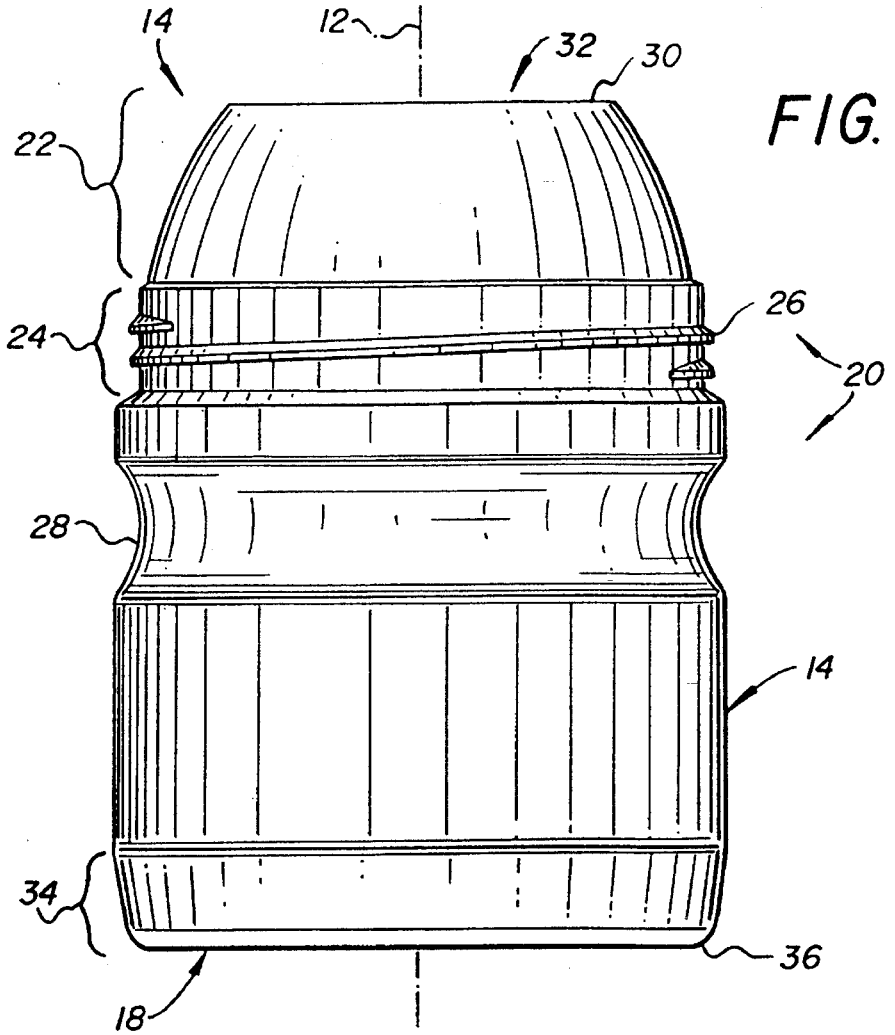
FIG. 3 is an elevation view of the base jar depicted in FIG. 1.
Figure 4:
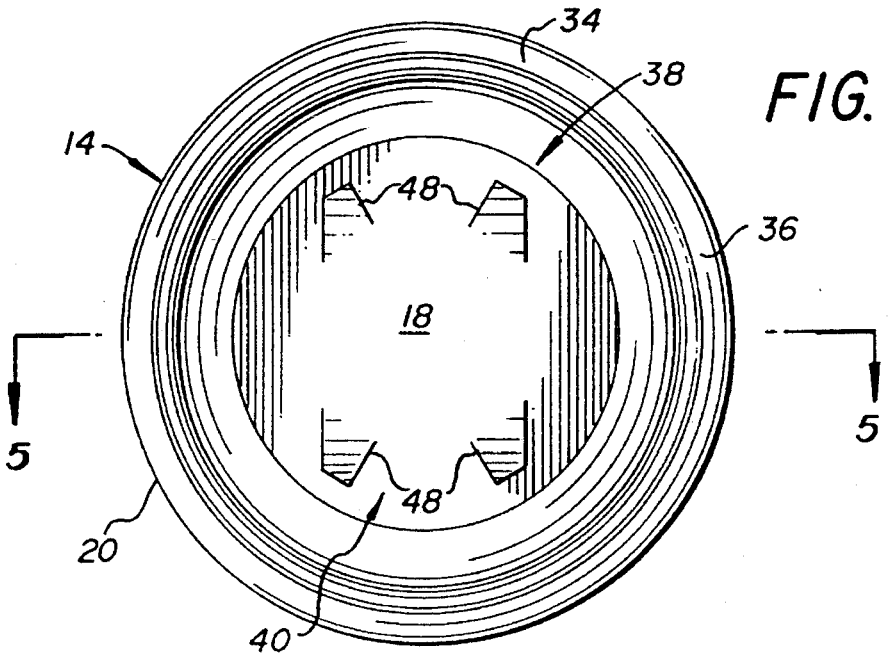
FIG. 4 is a bottom plan view of the container, and in particular of the base jar thereof, depicted in FIG. 1.

With reference now to the drawings in which like numerals represent like elements throughout the views, a sealed container 10 in accordance with the present invention is depicted in elevation in FIG. 1. Container 10 is broadly cylindrical in shape and is symmetrically formed radially about a central axis 12, although it will be apparent from the following description that portions could be other than radially symmetrical while others must be. It will also be appreciated that container 10 is comprised broadly of a base jar 14 which is used to contain some substance and a removable lid 16. In this preferred embodiment, the substance is preferably a fructose-containing powdered beverage mix, though obviously many other types of substances both solid, liquid, and liquid-like (i.e., powdered) could be contained. For convenience, base jar 14 and lid 16 are depicted separately and will thus be initially described separately.

As shown in greater detail in FIGS. 3–6, base jar 14 is broadly formed of a bottom wall 18, a side enclosure 20, and a curved upper wall 22. Side enclosure 20 extends upwardly from bottom wall 18 and includes an upper portion 24 having a screw thread 26 thereabout. Side enclosure 20 also includes a peripheral holding recess 28 formed as a curved concavity located below upper portion 24. Holding recess 28 provides a convenient location for a user to grasp base jar 14 (with or without lid 16), with holding recess 28 being sized to easily receive (on opposite sides thereof) the fingerprint area of a finger and thumb of the user. Base jar 14 is typically produced by blow molding techniques.

Upper wall 22 extends inwardly and upwardly from upper portion 20 and is curved to form a dome shape as shown. Upper wall 22 terminates at a circular brim 30 which is horizontally flat. It will be appreciated that upper wall 22 has an inside edge 33 formed at the intersection of circular brim 30 and an inside surface 31 of upper wall 22, which inside surface 31 is also rounded somewhat at bearing area 31*a* immediately adjacent inside edge 33 as shown. Inside edge 33 defines a mouth opening 32 for base jar 14. Adjacent circular brim 30 is a brim portion 35 at which a reduction 37 is provided in a thickness of upper wall 22 for a purpose to be discussed subsequently. Reduction 37 is preferably at least a 10% reduction in thickness over an adjoining portion of upper wall 22, and is preferably about 20%. It will also be appreciated that reduction 37 is provided along inside surface 31 and is preferably an arc shaped concavity as shown.

As container 10 is designed for a powdered beverage mix, it is desired for mouth opening 32 to be relatively wide to allow an easy pouring or removal of the beverage mix from base jar 14. For this reason, mouth opening 32 (defined by a diameter of inside edge 33) is preferably about 50 to 80% of a diameter of upper portion 24 (or the portion of side enclosure 20 therebelow), or more preferably about ⅔ of that diameter.

Figure 5:
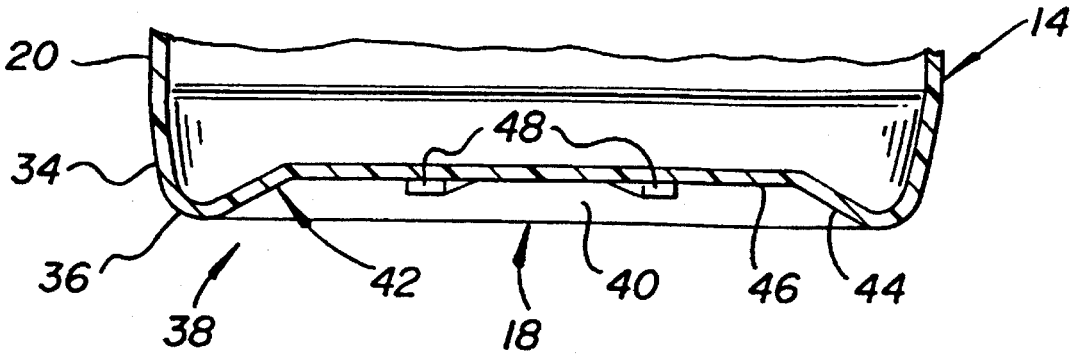
FIG. 5 is a cross-sectional elevation view taken along line 5—5 of the base jar depicted in FIG. 4.
Figure 6:
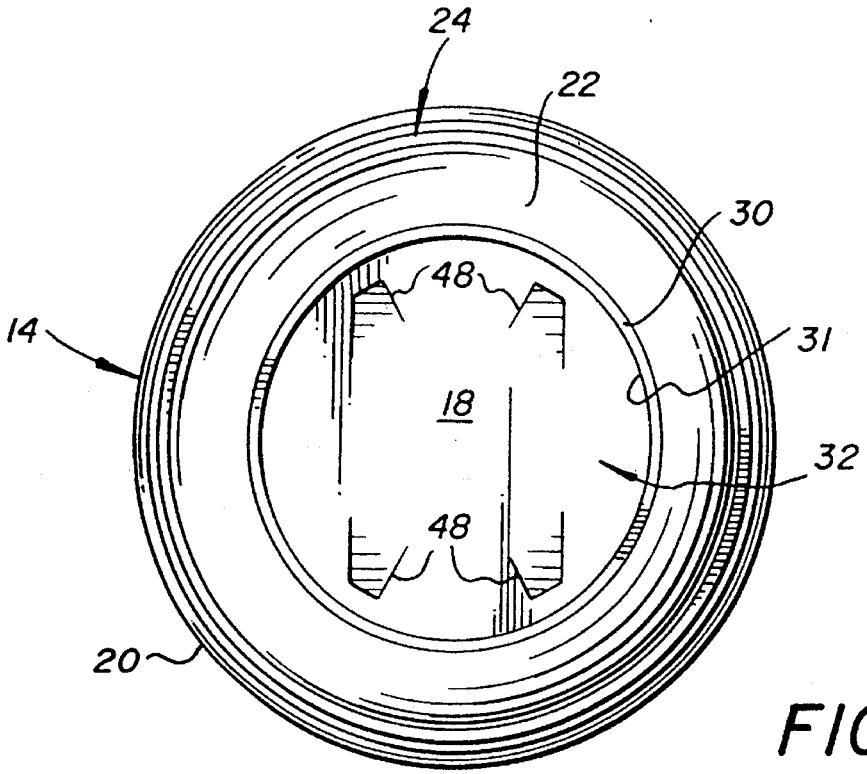
FIG. 6 is a top plan view of the base jar depicted in FIG. 3.
Figure 7:
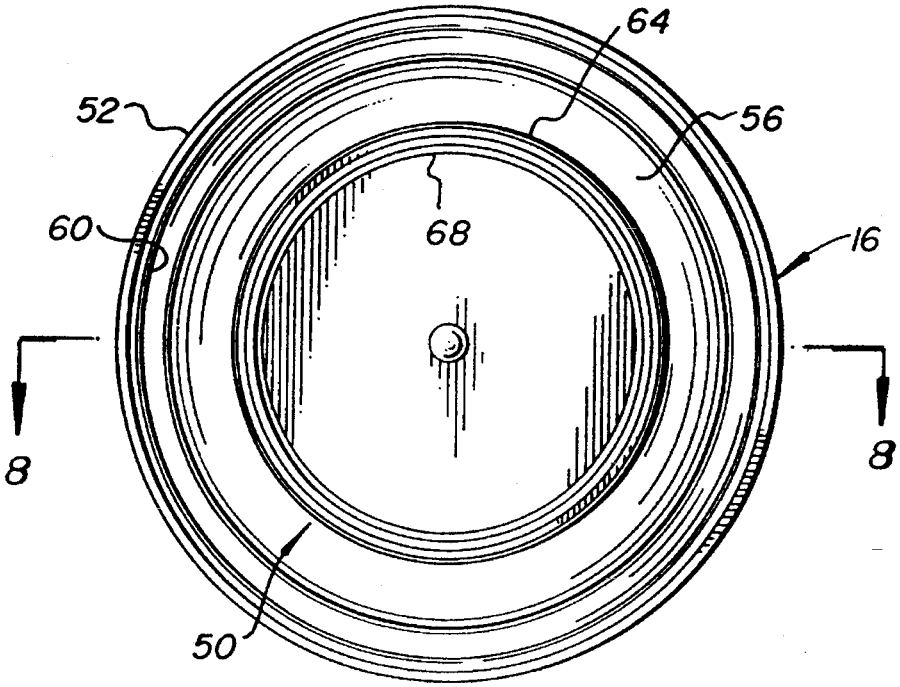
FIG. 7 is a bottom plan view of the lid depicted in FIG. 2.
Figure 8:
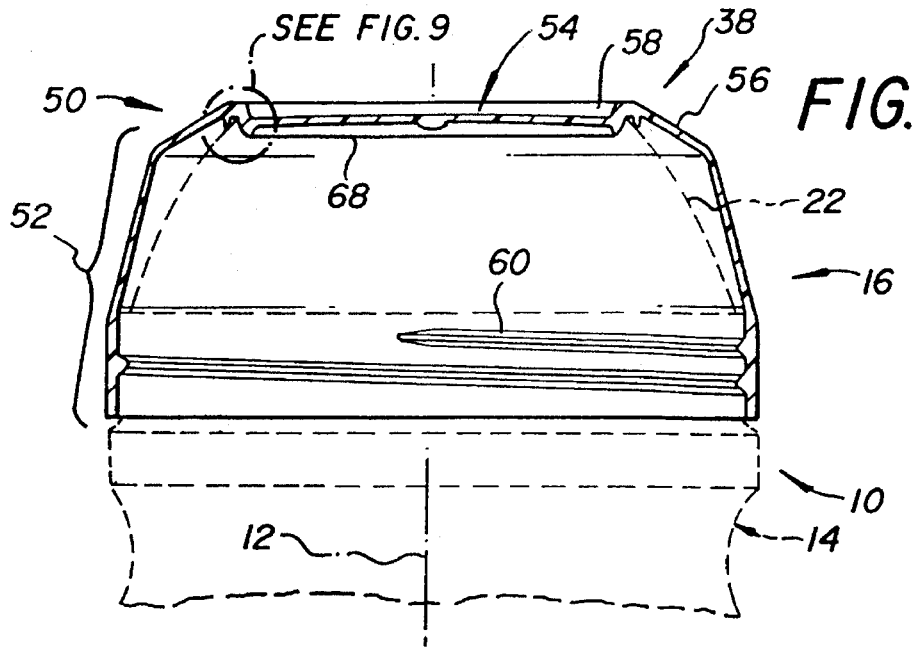
FIG. 8 is a cross-sectional elevation view taken along line 8—8 of the lid depicted in FIG. 7.

As shown best in FIG. 5, side enclosure 20 further includes a lower inclined portion 34 which joins bottom wall 18 at a rounded edge 36. Bottom wall 18 is then formed to create one half of a stacking means 38 by which one container 10 is easily stacked on top of another such container 10. (The other half of stacking means 38 is described subsequently with reference to lid 16.) Stacking means 38 includes a concavity 40 formed by bottom wall 18 having an exterior surface 42. In particular, it will be appreciated that exterior surface 42 includes an inclined surface 44 and a horizontal surface 46. In addition, stacking means 38 also includes stacking lugs 48 formed in bottom wall 18 and extending ramp-like as shown from horizontal surface 46 and terminating before inclined surface 44.

Depicted in greater detail in FIGS. 2 and 7–9 is lid 16. Lid 16 broadly includes a top wall 50 and an encircling member 52. Top wall 50 includes, as part of stacking means 38, a generally cylindrical (actually slightly frustoconical as shown) top recess 54 and an outer downwardly bevelled portion 56. It will thus be appreciated that exterior surface 42 (and particularly inclined surface 44) of bottom wall 18 of base jar 14 mates with bevelled portion 56 of an underlying container 10 to provide a nesting fit. Further, it will also be appreciated that stacking lugs 48 of bottom wall 18 are received within top recess 54 of top wall 50 of lid 16 to prevent too great of a sliding movement in any radial direction of base jar 14 relative to the underlying lid 16. The amount of sliding movement is thus approximately the separation distance of stacking lugs 48 from a cylindrical (slightly frustoconical) wall 58 of top recess 54. Lid 16 is typically produced by injection-molding techniques in order to obtain mass production of lids within relatively close tolerances.

Encircling member 52 of lid 16 includes a screw thread 60 on an inside thereof as shown. It will be appreciated that screw thread 60 matingly engages with screw thread 26 of base jar 14 to removably hold lid 16 on base jar 14. It will also be appreciated that lid 16 maybe conveniently used as a measuring receptacle or cup for the powdered beverage mix contained in base jar 14. Thus, lid 16 preferably includes a measuring indicia(s) along the inside surface thereof at the appropriate position.

Figure 9A:
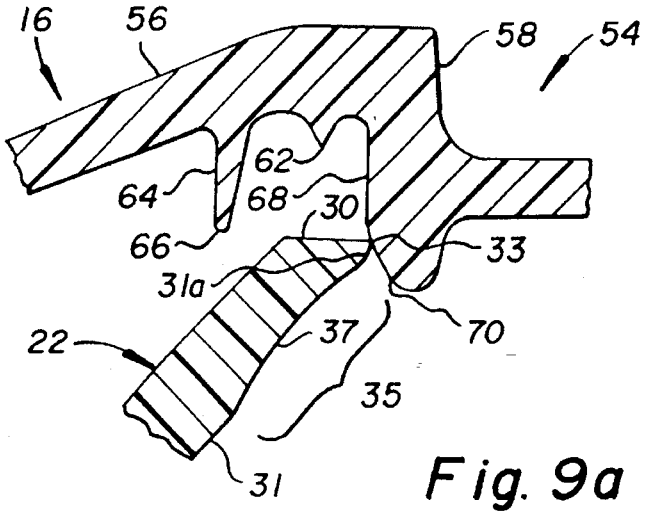
FIGS. 9*a*, 9*b*, and 9*c* are enlarged views of the identified portion of the lid and base jar depicted in FIG. 8 showing relative movements as the lid is sealed to the base jar.
Figure 9B:
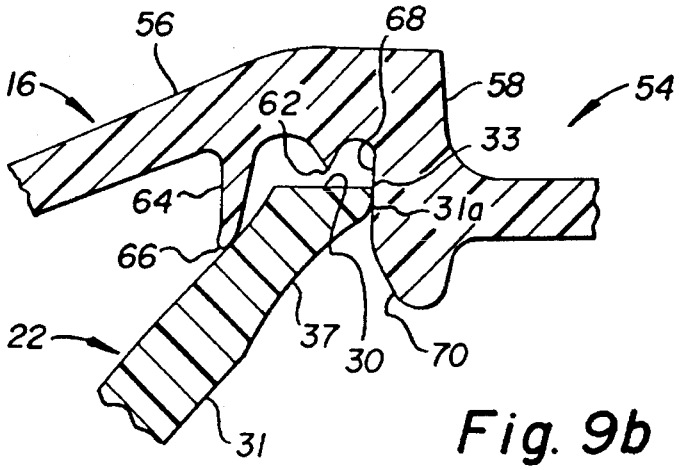
Figure 9C:
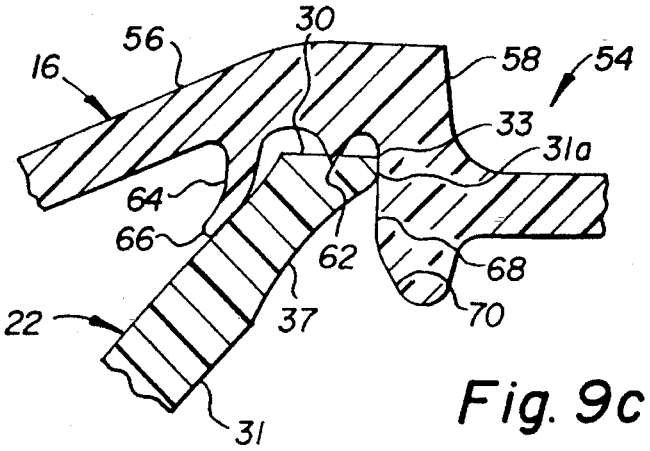

To provide one sealing of mouth opening 32 of base jar 14, lid 16 includes a circular V-shaped projection 62 extending downwardly therefrom as shown best in FIGS. 9*a–c*. Circular V-shaped projection 62 is radially offset from between a centering and sealing rim 68 and a circular flexible flange 64 (both discussed subsequently) toward central axis 12 as shown. After screw threads 26 and 60 engage to hold lid 16 on base jar 14, the engagement of which has drawn base jar 14 and lid 16 toward one another as shown by the progression of FIGS. 9*a–c*, circular V-shaped projection 62 digs or imbeds into circular brim 30 somewhat as shown in FIG. 9*c* (at least upon a tight factory tightening of lid 16 to base jar 14). Hence circular V-shaped projection 62 matingly seals all the way around the central axis 12 with the flat topmost surface of circular brim 30 as shown in FIG. 9*c*.

To provide another (and hence redundant) sealing of mouth opening 32 of base jar 14, lid 16 also includes circular flexible flange 64 extending downwardly from lid 16 radially about and downwards beyond circular projection 62. Flexible flange 64 tapers to a tip 66 as shown. Thus, slightly before circular projection 62 and circular brim 30 matingly engage (as screw threads 26 and 60 engage and bring base jar 14 and lid 16 toward one another), tip 66 is flexed radially outward relative to a remainder of flexible flange 64 by engagement with the portion of curved upper wall 22 immediately adjacent circular brim 30. This provides another and redundant seal completely about mouth opening 32.

To provide yet another (primary and further redundant) sealing of mouth opening 32, and additionally in order to assure the proper orientation (centering) of lid 16 on base jar 14 and hence the proper engagements of (a) circular V-shaped projection 62 with circular brim 30 and (b) tip 66 with upper wall 22, lid 16 is also provided with circular centering and sealing rim 68. Centering and sealing rim 68 assures that lid 16 is initially and continuously centered on base jar 14 as screw threads 26 and 60 engage, and thus that circular projection 62 is positively located to engage circular brim 30 and that flexible flange 64 is in position for tip 66 to engage upper wall 22.

Centering and sealing rim 68 extends below both circular projection 62 and tip 66 of flexible flange 64 so as to initially and positively engage inside edge 33 of circular brim 30. This initial engagement as shown in FIG. 9*a* assures the accurate radial location of centering rim 68 and hence the remainder of lid 16. To ease this centering action and provide for some initial play, centering rim 68 includes a lower outside surface 70 where initial contact with inside edge 33 is made which is inclined downwardly and inwardly as shown. In addition, inside wall 31 adjacent inside edge 33 is rounded at bearing area 31*a* as noted above. Further, by the placement of reduction 37 adjacent inside edge 33, brim portion 35 is somewhat more flexible than the remainder of upper wall 22 so that some radial upward and outward bending or flexing of brim portion 35 is allowed to accommodate for such play and centering to occur. Thus, if circular brim 30 is somewhat offset or out-of-round, brim portion 35 will bend and rounded bearing area 31*a* of inside surface 31 and/or inside edge 33 will then ride along lower outside surface 70. Quickly, inside edge 33 will become properly and symmetrically located in uniform engagement with centering rim 68, and thus upper wall 22 will ultimately be properly located when flexible flange 64 engages with upper wall 22 and circular projection 62 engages with circular brim 30.

It will also be appreciated that inside edge 33 and rounded bearing area 31*a* of inside surface 31 positively engage centering rim 68 and move therealong as screw threads 26 and 60 engage as shown by the progression of FIGS. 9*a–c*. As this occurs, inside edge 33 and rounded bearing area 31*a* of inside surface 31 are compressed somewhat due to the plastic material from which they are made, as shown by the deformation depicted in FIGS. 9*a–c*. This engagement and deformation thus provides an initial and positive seal for mouth opening 32. In order to insure effective sealing between inside edge 33 and centering rim 68 the base jar 14 and lid 16 are molded such that the radius about central axis 12 for inside edge 33 is less than the radius of the upper outside surface of centering rim 68 which produces the seal with inside edge 33. It will be appreciated that the sealing at inside edge 33 and rounded bearing area 31*a* of inside surface 31 is the primary or first seal actuated for container 10. Hence this seal will always be engaged by the consumer upon reapplying lid 16 to base jar 14 after the initial consumer opening so long as lid 16 is twisted to engage threads 26 and 60 until some resistance is met— which is the engagement of inside edge 33 with centering rim 68. Obviously, further tightening of lid 16 then engages flexible flange 64 with upper wall 22 as shown in FIG. 9*b* and then (if lid 16 is made very tight to base jar 14) V-shaped projection 62 with circular brim 30 as shown in FIG. 9*c*.

Figure 10:
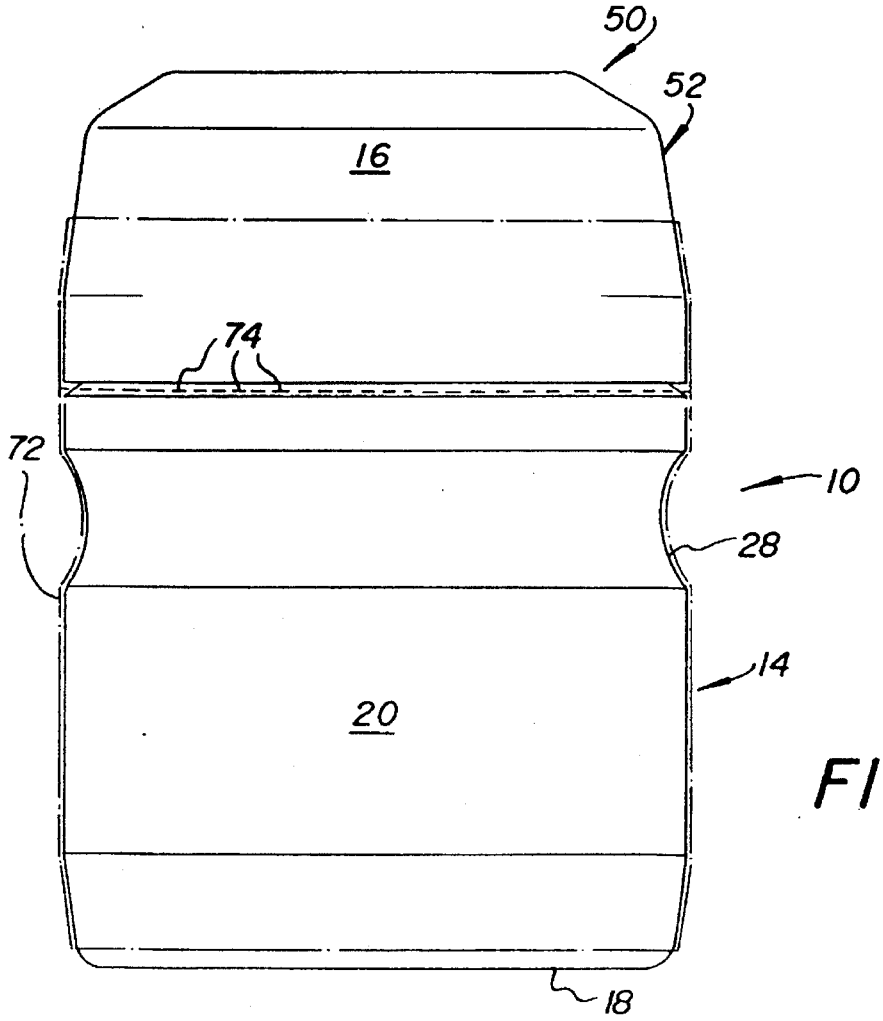
FIG. 10 is an elevational schematic view of the container depicted in FIG. 1 with a label attached thereto.

After filling and sealing the container, a heat shrink label 72 is applied about container 10 as depicted by the broken lines in FIG. 10. Heat shrink label 72 includes perforations or slits 74 adjacent the gap provided between lid 16 and side enclosure 20 so that label 72 is easily broken at perforations 74 by twisting of lid 16 in order to open container 10. It will thus be appreciated that label 72 also serves as a tamper indicator so that container 10 cannot be opened without breaking label 72.

Label 72 is preferably applied to container 10 in the manner disclosed in U.S. Pat. No. 4,977,002 (Hoffman). It will be appreciated that label 72 extends vertically onto lower portion 34 of base jar 14 which slopes radially inward and vertically onto the portion of encircling member 52 which similarly slopes radially inward. Thus, once label 72 is shrunk onto container 10 at these sloping portions, label 72 is positively locked or retained in position by the shrunk portions thereof at these (oppositely) inward sloping portions.

In use, container 10 is formed as a base jar 14 and lid 16 as described above and the desired substance deposited in base jar 14. Thereafter, lid 16 is applied to base jar 14 and heat shrunk label 72 applied to container 10. In this form, it will be appreciated that the substance in container 10 is triply sealed by: the engagement of circular projection 62 with circular brim 30, the engagement of tip 66 of flexible flange 64 with upper wall 22 of base jar 14, and the engagement of inside edge 33 with centering rim 68. Container 10 is thus suitable for boxing, shipping and displaying, and containers 10 are stackable one on top of another by use of stacking means 48 during these operations. Thereafter, the user simply opens container 10 by twisting lid 16 relative to base jar 14 to break label 72 at perforations 74. Once the desired amount of the substance inside of base jar 14 is removed, such as by using lid 16 as a measuring cup, lid 16 is re-screwed onto base jar 14 to effect a single sealing (if lid 16 is lightly tightened onto base jar 14, as shown in the beginning stage in FIG. 9*a*), a double sealing (if lid 16 is moderately tightened onto base jar 14, as shown in FIG. 9*b*), or a triple sealing arrangement (if lid 16 is strongly tightened onto base jar 14 as shown in FIG. 9*c*).

Although the present invention has been described relative to a preferred embodiment thereof, it will be appreciated that other configurations consistent with the invention would be possible. For example, if desired, side enclosure 20 below upper portion 24 could be other than cylindrical, such as square. Similarly, this part of side enclosure 20 need not be formed about central axis 12 but could be offset if desired.

Thus, while the present invention has been described with respect to an exemplary embodiment thereof, it will be understood by those of ordinary skill in the art that variations and modifications can be effected within the scope and spirit of the invention.

What is claimed is:

1. A sealed container which is easily opened comprising:

a base jar for containing a substance, said jar including
a bottom wall,
a side enclosure extending upwardly from said bottom wall and including an upper portion disposed radially about a central axis with a screw thread about said upper portion,
a curved upper wall extending inwardly and upwardly from said upper portion of said side enclosure and radially about the central axis, said upper wall including (a) a circular brim which defines a mouth opening for said jar, (b) a brim portion adjacent said brim provided with at least a 10% reduction in thickness from an adjoining portion of said upper wall, and (c) an inside edge at an intersection of said circular brim and an inside surface of said brim portion; and a removable lid for said jar which seals said opening, said lid including
a top wall disposed about the central axis,
an encircling member extending downwardly from said top wall and radially about the central axis, said encircling member including a screw thread which matingly engages with said screw thread of said upper portion of said jar,
a circular V-shaped projection extending downwardly from said lid and radially about the central axis which engages and seals with said circular brim after said screw threads of said jar and lid engage,
a circular flexible flange extending downwardly from said lid and radially about said circular projection and the central axis, said flexible flange having a tip which is radially flexed relative to a remainder of said flange upon engagement with said upper wall of said jar to seal therewith as said circular projection and circular brim matingly engage, and
a circular centering and sealing rim extending downwardly from said top wall and radially about the central axis just inside and downwardly beyond said circular projection such that before engagement of said circular projection with said circular brim and before engagement of said tip of said flexible flange with said upper wall of said jar, said centering rim engages said inside edge of said upper wall to form a seal therebetween and to positively locate said circular projection vertically adjacent said circular brim, the radius about the central axis for the inside edge of said circular brim being less than the radius of said centering rim.

2. A sealed container as claimed in claim 1 wherein said reduction in thickness of said brim portion is provided along said inside surface thereof.

3. A sealed container as claimed in claim 2 wherein said reduction in thickness of said brim portion is about 20%.

4. A sealed container as claimed in claim 2 wherein said reduction in thickness of said brim portion is an arc shaped concavity.

5. A sealed container as claimed in claim 1 wherein said circular projection is located between said centering rim and said circular flexible flange at a radial location closer to said centering rim than to said circular flexible flange.

6. A sealed container as claimed in claim 1 wherein said inside surface adjacent said inside edge is rounded to better move along and seal to said circular centering rim as engagement of said circular projection with said circular brim and engagement of said tip of said flexible flange with said upper wall of said jar occurs.

7. A sealed container as claimed in claim 2 wherein said circular projection is located between said centering rim and said circular flexible flange at a radial position closer to said centering rim than to said circular flexible flange.

8. A sealed container as claimed in claim 7 wherein said inside edge is rounded to better move along and seal to said circular centering rim as engagement of said circular projection with said circular brim and engagement of said tip of said flexible flange with said upper wall of said jar occurs.

9. A sealed container as claimed in claim 8 wherein said centering rim includes a lower outside surface which is inclined downwardly and inwardly.

10. A sealed container as claimed in claim 9 wherein said curved upper wall forms a dome.

11. A sealed container as claimed in claim 10 wherein said circular brim has a diameter which is 50 to 80% of a diameter of said upper portion of said of said side enclosure.

12. A sealed container which is easily opened comprising:

a cylindrical base jar symmetrically formed radially about a central vertical axis for containing a substance, said jar including
a bottom wall,
a side enclosure extending upwardly from said bottom wall and including an upper portion with a screw thread about said upper portion,
a curved upper curved wall extending inwardly and upwardly from said upper portion of said side enclosure to form a dome shape, said upper wall including (a) a circular brim which defines a mouth opening for said jar, (b) a brim portion adjacent said brim provided with at least a 10% reduction in thickness from an adjoining portion of said upper wall, and (c) an inside edge at an intersection of said circular brim and an inside surface of said brim portion; and a removable cylindrical lid for said jar which seals said opening and which is also symmetrically formed radially about the central vertical axis, said lid including
a top wall,
an encircling member extending downwardly from said top wall and including a screw thread which matingly engages with said screw thread of said upper wall of said jar,
a circular projection extending downwardly from said lid which engages and seals with said circular brim after said screw threads of said jar and lid engage,
a circular flexible flange extending downwardly from said lid and about said circular projection, said flexible flange having a tip which is radially flexed relative to a remainder of said flange upon engagement with said upper wall of said jar to seal therewith as said circular projection and circular brim matingly engage, and
a circular centering and sealing rim extending downwardly from said top wall just inside and downwardly beyond said circular projection such that before engagement of said circular projection with said circular brim and before engagement of said tip of said flexible flange with said upper wall of said jar, said centering rim engages said inside edge of said upper wall to form a seal therebetween and to positively locate said circular projection vertically adjacent said circular brim, the radius about the central axis for the inside edge of said circular brim being less then the radius of said centering rim.

13. A sealed container as claimed in claim 12 wherein said reduction in thickness of said brim portion is provided along said inside surface thereof.

14. A sealed container as claimed in claim 13 wherein said reduction in thickness of said brim portion is about 20%.

15. A sealed container as claimed in claim 13 wherein said reduction in thickness of said brim portion is an arc shaped concavity.

16. A sealed container as claimed in claim 12 wherein said circular projection is located between said centering rim and said circular flexible flange at a radial position closer to said centering rim than to said circular flexible flange.

17. A sealed container as claimed in claim 12 wherein said inside surface adjacent said inside edge is rounded to better move along and seal to said circular centering rim as engagement of said circular projection with said circular brim and engagement of said tip of said flexible flange with said upper wall of said jar occurs.

18. A sealed container as claimed in claim 13 wherein said circular projection is located between said centering rim and said circular flexible flange at a radial position closer to said centering rim than to said circular flexible flange.

19. A sealed container as claimed in claim 18 wherein said inside edge is rounded to better move along and seal to said circular centering rim as engagement of said circular projection with said circular brim and engagement of said tip of said flexible flange with said upper wall of said jar occurs.

20. A sealed container as claimed in claim 19 wherein said centering rim includes a lower outside surface which is inclined downwardly and inwardly.

* * * * *